US007958700B2

(12) United States Patent
Weitzel

(10) Patent No.: US 7,958,700 B2
(45) Date of Patent: Jun. 14, 2011

(54) SYSTEM, METHOD, AND APPARATUS FOR PACKAGING COINS

(76) Inventor: Scott Allen Weitzel, Brighton, CO (US)

( * ) Notice: Subject to any disclaimer, the term of this patent is extended or adjusted under 35 U.S.C. 154(b) by 1124 days.

(21) Appl. No.: 11/398,307

(22) Filed: Apr. 4, 2006

(65) Prior Publication Data

US 2007/0227098 A1 Oct. 4, 2007

(51) Int. Cl.
*B65B 35/30* (2006.01)
*B65B 35/06* (2006.01)

(52) U.S. Cl. ..... 53/443; 53/532

(58) Field of Classification Search ..... 53/448, 53/443, 147, 532, 537, 206, 52, 493, 501, 53/70; 453/31, 59, 63
See application file for complete search history.

(56) References Cited

U.S. PATENT DOCUMENTS

| | | | | | |
|---|---|---|---|---|---|
| 3,696,582 | A * | 10/1972 | Lodrick et al. | 53/501 |
| 3,934,389 | A * | 1/1976 | Cryor | 53/213 |
| 4,279,113 | A * | 7/1981 | Halm | 53/219 |
| 4,442,850 | A * | 4/1984 | Austin et al. | 453/5 |
| 4,546,875 | A * | 10/1985 | Zweber | 206/0.82 |
| 4,878,579 | A * | 11/1989 | Hager | 206/0.84 |
| 5,853,322 | A * | 12/1998 | Jones et al. | 453/63 |
| 5,918,742 | A * | 7/1999 | Moon | 206/459.5 |
| 6,200,213 | B1 * | 3/2001 | Cole | 453/30 |
| 6,397,565 | B2 * | 6/2002 | Ohshita | 53/501 |
| 6,598,376 | B2 * | 7/2003 | Ohshita | 53/501 |

* cited by examiner

*Primary Examiner* — Rinaldi I. Rada
*Assistant Examiner* — John Paradiso
(74) *Attorney, Agent, or Firm* — Scott Weitzel

(57) ABSTRACT

In one embodiment, a system has components that include A) an interface to receive a signal associated with a point-of-sale transaction, the signal further indicating coins to be given to a customer in accord with the point-of-sale transaction; B) a first dispenser to access a number of coins in accord with the signal; and C) a packager to package the accessed coins.

21 Claims, 8 Drawing Sheets

SYSTEM, METHOD, AND APPARATUS FOR PACKAGING COINS

BACKGROUND

Even with the ability to purchase goods and services without cash (e.g., credit cards, debit cards, electronic fund transfers), cash is still a common means to pay for many purchases. Coins are commonly returned to a customer of a point-of-sale (POS) transaction. A customer purchases goods and services, presents the merchant with an amount of cash, and the cash in excess of the cost of the goods and services is returned to the customer in the form of change. Depending on the amount of change due, the change may comprise bills and/or coins.

Providing coins to customers can be problematic. Change must be counted correctly and handed to the customer. In situations where the customer or merchant is rushed or occupied with other tasks, such as when a customer is more focused on the placement of food and drinks securely in their vehicle after purchasing such items at a drive-up window, the coins may be problematic.

Handling coins or any currency provides an opportunity for error and theft. Customers who are "short changed" as a result of error or theft by a merchant or employee of the merchant may never complain but, instead, discontinue business with the merchant. Similarly, merchants who provide an overage of change to a customer may spend more time determining if an error actually exists and addressing the error, than what the error actually cost. POS transactions often involve providing change to a customer as well as other items (e.g., bills, receipts, purchased items). The merchant and customer may then fumble with coins, which in turn, may distract the customer and/or merchant and cause higher value items to be mishandled or inadvertently omitted from the transaction.

SUMMARY OF THE INVENTION

In one embodiment, a system comprises A) an interface to receive a signal associated with a point-of-sale transaction, the signal further indicating coins to be given to a customer in accord with the point-of-sale transaction; B) a first dispenser to access a number of coins in accord with the signal; and C) a packager to package the accessed coins.

In another embodiment, a method of automatically packaging coins has the steps of A) receiving a signal associated with a point-of-sale transaction, the signal further indicating coins to be given to a customer in accord with the point-of-sale transaction; B) accessing a number of coins in accord with the signal; and C) packaging the number of coins.

In another embodiment, an apparatus, comprises A) signal processor to process a received signal indicating coins to be packaged in response to a point-of-sale transaction; B) a magazine operable to hold coins; C) a first dispenser to access a number of coins, from the magazine, in accord with the signal; and D) a packager to package the accessed coins.

Other embodiments are also disclosed.

BRIEF DESCRIPTION OF THE DRAWINGS

Illustrative embodiments of the invention are illustrated in the drawings, in which.

DETAILED DESCRIPTION

Figure 1:
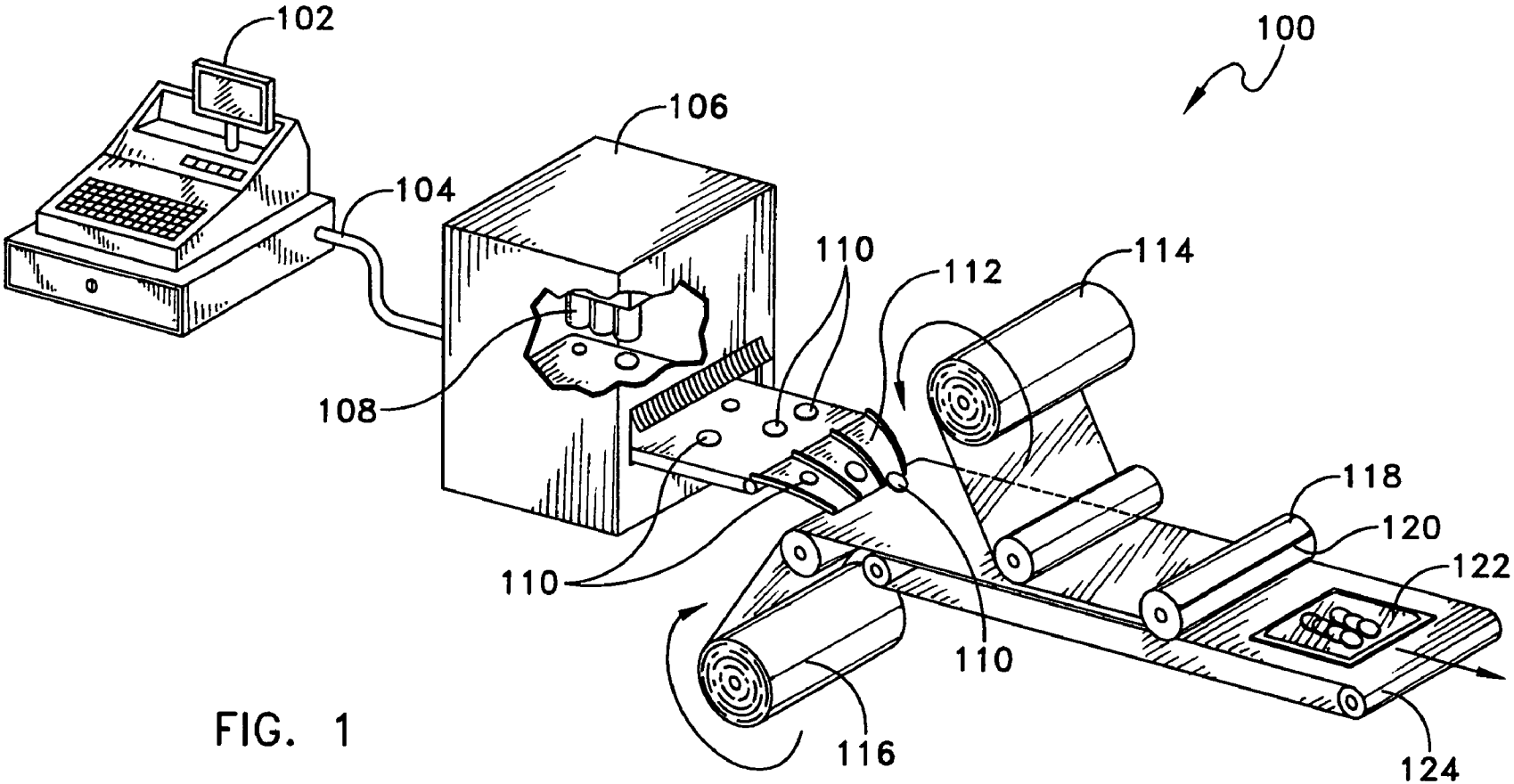
FIG. 1 illustrates an exemplary system for packaging coins.

As a preliminary matter, it is noted that, in the following description, like reference numbers appearing in different drawing figures refer to like elements/features. Often, therefore, like elements/features that appear in different drawing figures will not be described in detail with respect to each of the drawing figures.

Bulk coin packaging, such as wrapping a numbers of coin rolls and bulk bags provide a means to package large numbers of coins in response to commercial transactions. However, such bulk coin packaging is not in response to individual point-of-sale transactions. Packaging of coins, in the embodiments herein relates to the forming of a package with a number of coins therein, in response to individual point-of-sale transactions. Additional advantages are achieved if the resulting coin package is planar, for example, to facilitate a customer's handing of the coin package in manner similar to the manner of handing paper currency.

FIG. 1 illustrates exemplary system 100 for packaging coins 110. A signal is generated, such as by point-of-sale ("POS") terminal 102 (e.g., cash register) indicating that a coins are to be provided to the customer as a result of the POS transaction. POS transaction are retail transactions wherein currency is provided for the purchase of goods or services. The signal is provided to first dispenser 106 via an interface. The interface is variously embodied and includes electronic interfaces (e.g., Ethernet, radio frequency, infrared, or other wired, wireless, and mechanical connections) as well as human interfaces. The interface providing the signal to first dispenser 106 may also be a human interface. For example, a user may input a command (e.g., "give five dimes", "give $0.32", et cetera) to the interface to mechanically and/or electrically provide the signal to first dispenser 106. In the embodiment illustrated, connection 104 provides an electronic signal to an interface (not shown for clarity) of first dispenser 106.

First dispenser 106 accesses a number of coins 110 in response to the signal. Coins 110 may be kept in magazines 108 or other accessible storage. Accessing coins 110 is also variously embodied. Chute 112 provides one means to assemble coins 110 for packaging. Accessing coins 110 may be via pick-and-place electromechanics/pneumatics; a releasable catch for retaining coins in a gravity, spring, or mechanically fed source; cogged wheels/belts to select and/or position coins, and/or other means to select and position coins 110 for packaging.

The signal provided to first dispenser 106 may include a simple value (e.g., "$0.84") or specific denominations (e.g., 3-quarters, 2-dimes, 1-nickle). The signal may include extra information, such as "$3.84", where only the change portion (e.g., "84¢") affects the coins accessed. The extra information may be utilized for other purposes, such as printing (see FIGS. 7-8).

Once coins 110 are accessed, they are ready for packaging. In a further embodiment the coins are packaged such that they form a substantially planar coin package 122. The packager is variously embodied. Here, components 114, 116, 118, 120, 124 form one exemplary packager. Certain advantages are realized if the packager, as well as other components, are in a compact form factor, particularly a compact footprint. One such form factor is realized by providing for the packaging of coins 110 via a substantially vertical flow through the packaging components 114, 116, 118, 120, 124. In the horizontal embodiment illustrated, bottom sheet roll 116 provides a bottom surface of the package and coins 110 may be placed thereupon. Top sheet roll 114 provides a top surface to coin package 122. Roller 118 illustrates one embodiment to attach top sheet 114 to bottom sheet 116 to form coin package 122. Roller 118 crimps top sheet 114 and bottom sheet 116 and cutter 120 trims coin package 122. Cutter 120 may be a stamp, fixed blade, rotating or reciprocating blade, or there trimming means. Cutter 120 may be utilized before top sheet and bottom sheet 114, 116 are joined. Cutter 120 may be omitted when top sheet 114 and bottom sheet 116 are in a desired form (e.g., in card form) to create coin package 122. Conveyer 124 provides one means to move coins 110 through various stages of packaging.

In other embodiments, top and bottom sheets 114, 116 are joined with a heated die to partially cause at least one of top sheet 114 and bottom sheet 116 to adhere to the other and/or coins 110. In still other embodiments, top and bottom sheet 114, 116 are joined with adhesives (e.g., water-activated, chemical-activated, pressure sensitive, et cetera) or other joining means. As a matter of design choice, based substantially on the materials selected for either 1) at least one of top and bottom sheets 114, 116 or 2) a joining material utilized to join top and bottom sheets 114, 116, other joining means may be utilized (e.g., ultraviolet curing) for joining top and bottom sheets 114, 116.

In another embodiment, package 122 is formed as a pouch and coins 110 are placed therein and sealed to contain coins 110. In another embodiment, a vacuum chamber is provided wherein package 122 is air tight (see, FIG. 4) to produce package 112 to restrict the motion of coins 110 within package 122 caused by a reduced pressure within package 122. Other means to restrict the motion of coins 110 within package 122 include providing package 122 with a tacky interior surface or a surface with a high affinity to coins 110 or itself (e.g., the top sheet 114 clings to the bottom sheet 116 or to coins 110). Coin package 122 is variously embodied and includes the embodiments of FIGS. 2-8.

System 100 may employ a second dispenser. Second dispenser dispenses coin package 122, such as to a merchant or customer. In its simplest form the second dispenser is a tray to hold coin package 122 until retrieved by a merchant or customer. In a more complex form, the second dispenser includes mechanics for moving coin package 122 to a customer or merchant.

Figure 2:
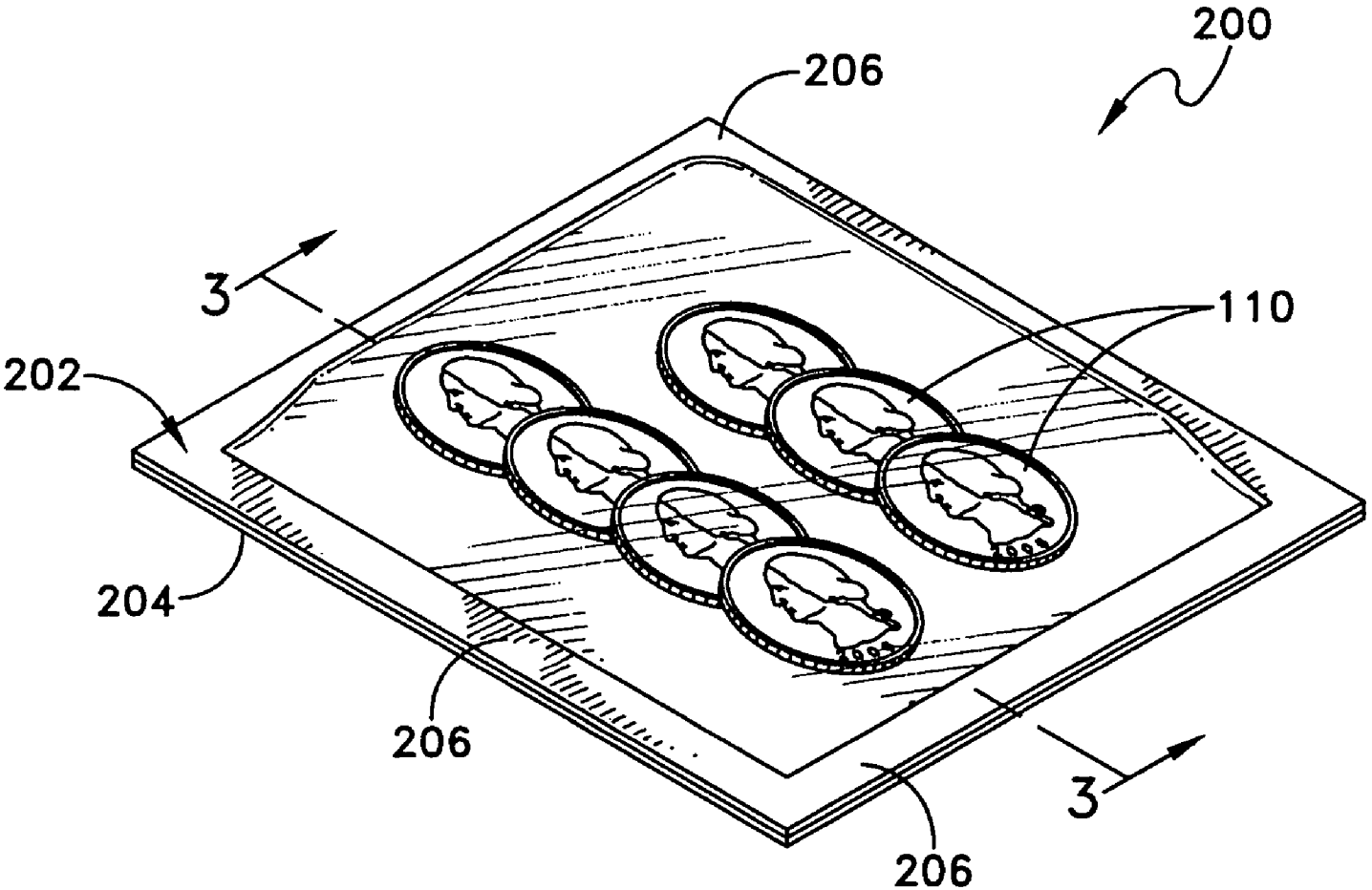
FIG. 2 illustrates a first exemplary coin package, such as may be produced by the system of FIG. 1.

FIG. 2 illustrates first exemplary coin package 200, such as may be produced by the system of FIG. 1. Coins 110 are placed in package 200. It should be appreciated that coins 110 illustrated in the drawings of this disclosure are shown as identical denominations as convenience and not in the limiting sense.

Coin package 200 contains coins 110 in a substantially planar form factor. Top sheet 202 and bottom sheet 204 are attached around perimeter 206 to contain coins 110 therein. The attachment of top sheet 202 and bottom sheet 204 may be continuous, intermittent, or air tight. In other embodiments, top sheet 202 and bottom sheet 204 may be attached at a plurality of locations in the interior of coin package 200 (e.g., between ones of coins 110).

In the embodiments herein, coins 110 may be illustrated as a specific number of coins. Such illustrations are for clarity in conveying the embodiments and not as a limitation of the embodiments. However, in implementing the embodiments it is often preferable to limit the number, value, or both of coins 110 within package 200. The exact limit is a matter of design choice dependent on the dimensions and/or values of the coins eligible for packaging in package 200. For example, it may be preferable if coins 110 are not so numerous as to make package 200 overly stressed, large, or deformed.

It may also be preferable if the number of coins 110 is limited to a certain value (e.g., a value not exceeding the smallest denomination paper currency). As an example, this may be particularly beneficial in the United States where it is desirable not to provide coin change greater than one dollar, unless dollar bills are unavailable or the customer requests additional coins instead of paper currency. In other situations, the limit on the number or denominations of coins 110 in package 200 is determined as a matter of design choice.

Coins 110 generally refer to legal tender but may also include other similarly shaped items with a monetary purpose (e.g., casino chips, arcade tokens, subway/bus tokens), wherein coins 110 result from a POS transaction for the purchase of, for example, an opportunity to play a game of chance or skill, entertainment, or passage.

Figure 3:
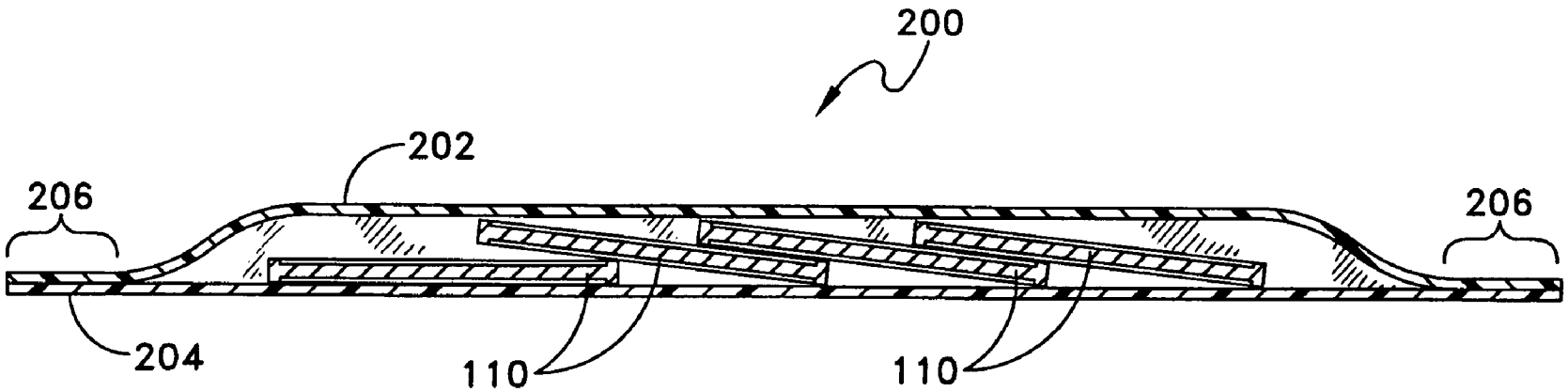
FIG. 3 illustrates a cross sectional view of the coin package of FIG. 2 along line 3-3.

FIG. 3 illustrates a cross sectional view of coin package 200, along line 3-3 of FIG. 2. Coins 110 are shown in package 200 partially overlapping one another. In other embodiments, coins 110 are placed in various orientations in a way such that coins 110 do not form a single column within coin package 200 and thereby form a substantially planar form factor.

Top sheet 202 and bottom sheet 204 are shown consisting of the same material in FIG. 3. Seal 206 attaches top sheet 202 to bottom sheet 204 to contain coins 110 within coin package 200. Seal 206 may be created on at least one side of package 200 by folding a contiguous sheet, wherein the fold creates top sheet 202 and bottom sheet 204. Seal 206 may be created with heat, crimping, and/or with the benefit of an adhesive.

Figure 4:
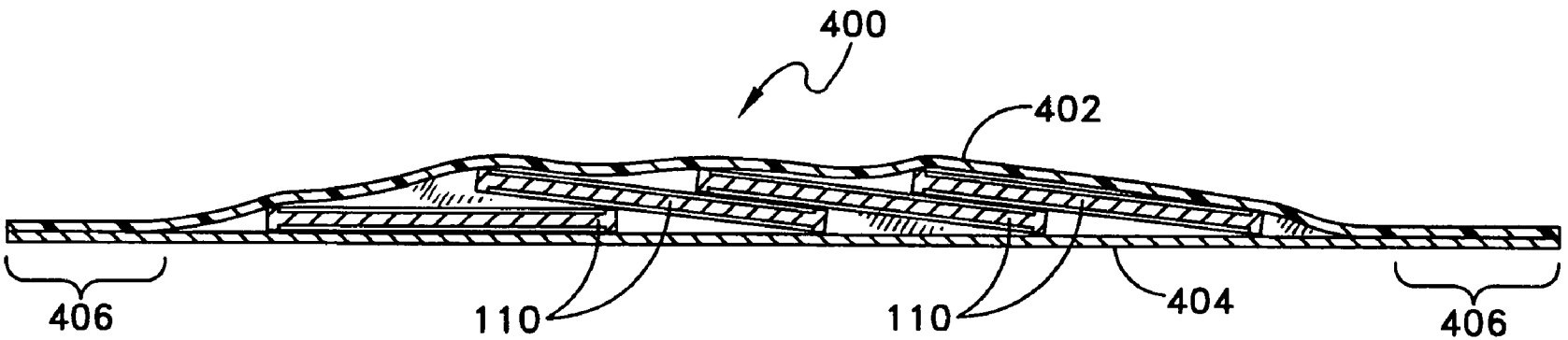
FIG. 4 illustrates a cross sectional view of a second coin package.

FIG. 4 illustrates a cross sectional view of second coin package 400. Top sheet 402 is made of a first material (e.g. plastics) and bottom sheet 404 is made of a second material (e.g., paper, cardboard, dissimilar plastic). Second coin package 400 illustrates a contouring effect of top sheet 402, such as when created by system 100 of FIG. 1 applying a vacuum during the sealing stage and forming seal 406 as an air tight seal with a reduced air pressure within coin package 400.

Figure 5:
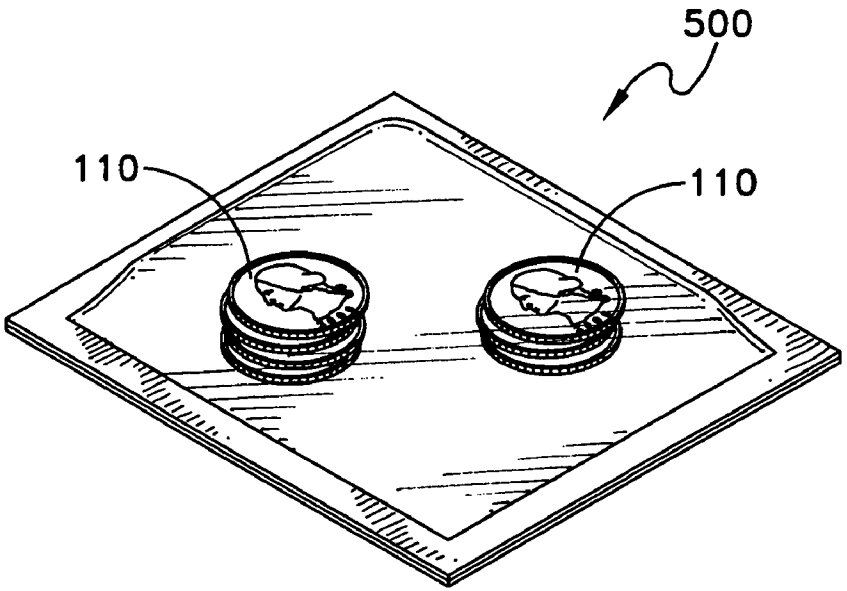
FIG. 5 illustrates an exemplary third coin package.

FIG. 5 illustrates exemplary third coin package 500. Coin package 500 illustrates coins 110 arranged in an overall substantially planar form comprising a number of columns of coins 110.

Figure 6:
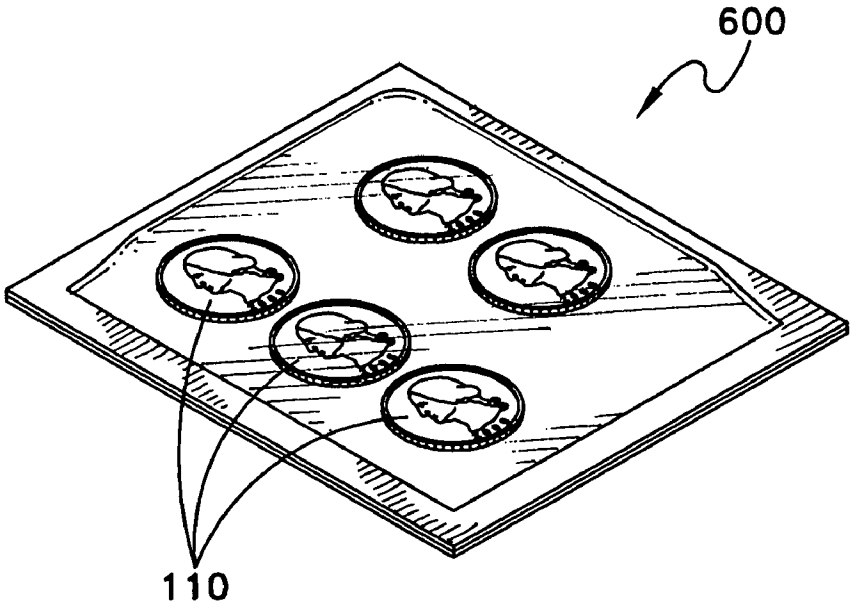
FIG. 6 illustrates an exemplary fourth coin package.

FIG. 6 illustrates exemplary fourth exemplary coin package 600. Coin package 600 illustrates coins 110 in a non-overlapping configuration.

Figure 7:
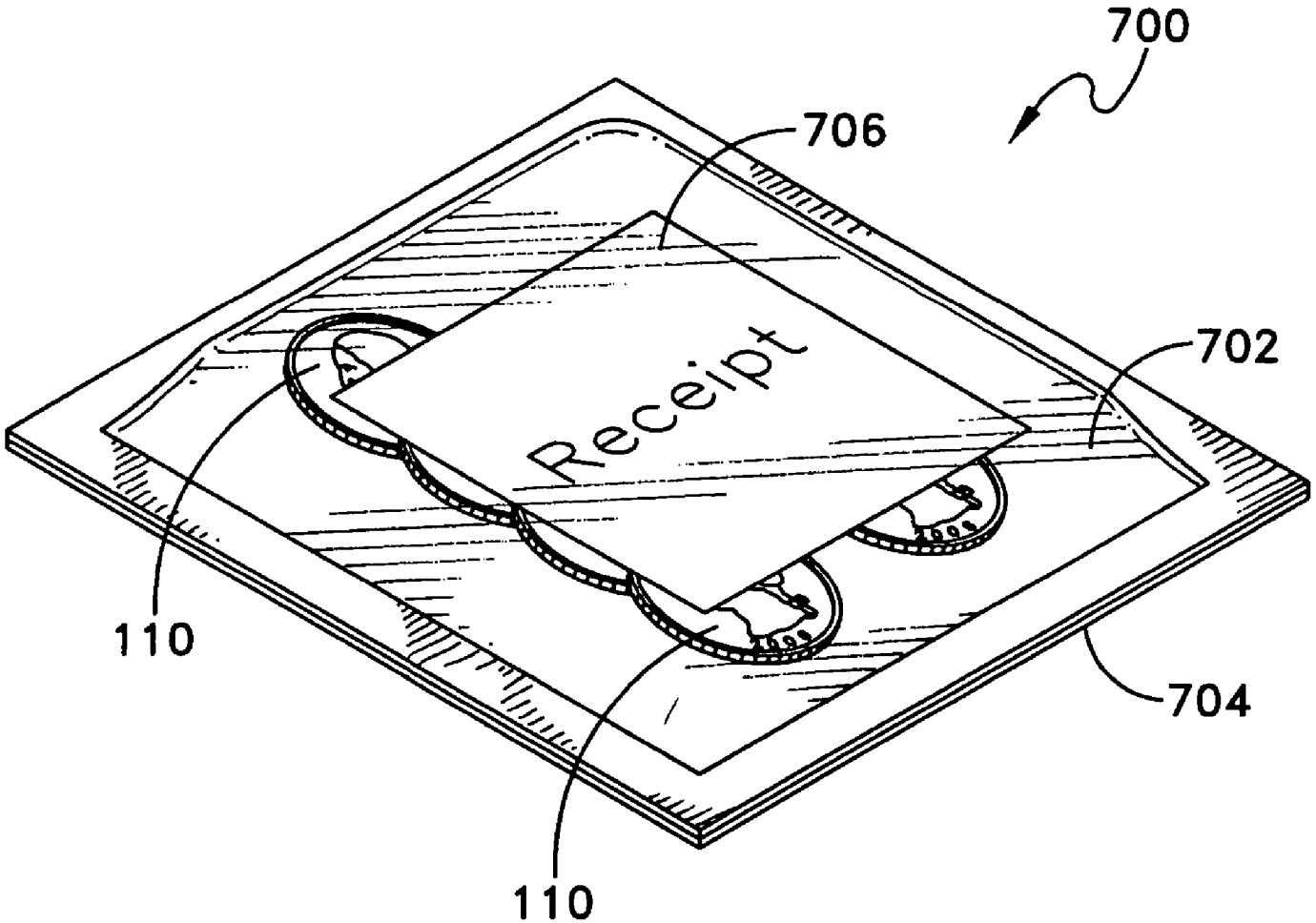
FIG. 7 illustrates a coin package with exemplary first printing area.

FIG. 7 illustrates coin package 700 with exemplary first printing area 706. In one embodiment first printing area 706 is of a different material than top sheet 702. For example printing area 706 may be paper fixed to top sheet 702. In a further embodiment, printing area 706 may be removable from coin package 700. In another embodiment, printing area 706 may be a "frosted" surface of top sheet 702, wherein top sheet 702 is chemically or mechanically roughened to accept printing. In another embodiment, printing area 706 is the same as top sheet 702. In another embodiment, printing area 706 may be on the interior of top sheet 702, wherein top sheet 702 is transparent. In still another embodiment, printing area 706 may be located on bottom sheet 704.

The content of the printing placed on printing area 706 is a matter of design choice and may include the value of the coins within coin package 700, the number of coins within coin package 700, a receipt of the POS transaction for which coin package 700 was formed, coupons, advertisements, or other markings. It may be preferable if print on printing area 706 is performed prior to the introduction of coins 110, although the timing as to when to place printing on printing area 706 is a matter of design choice.

Figure 8:
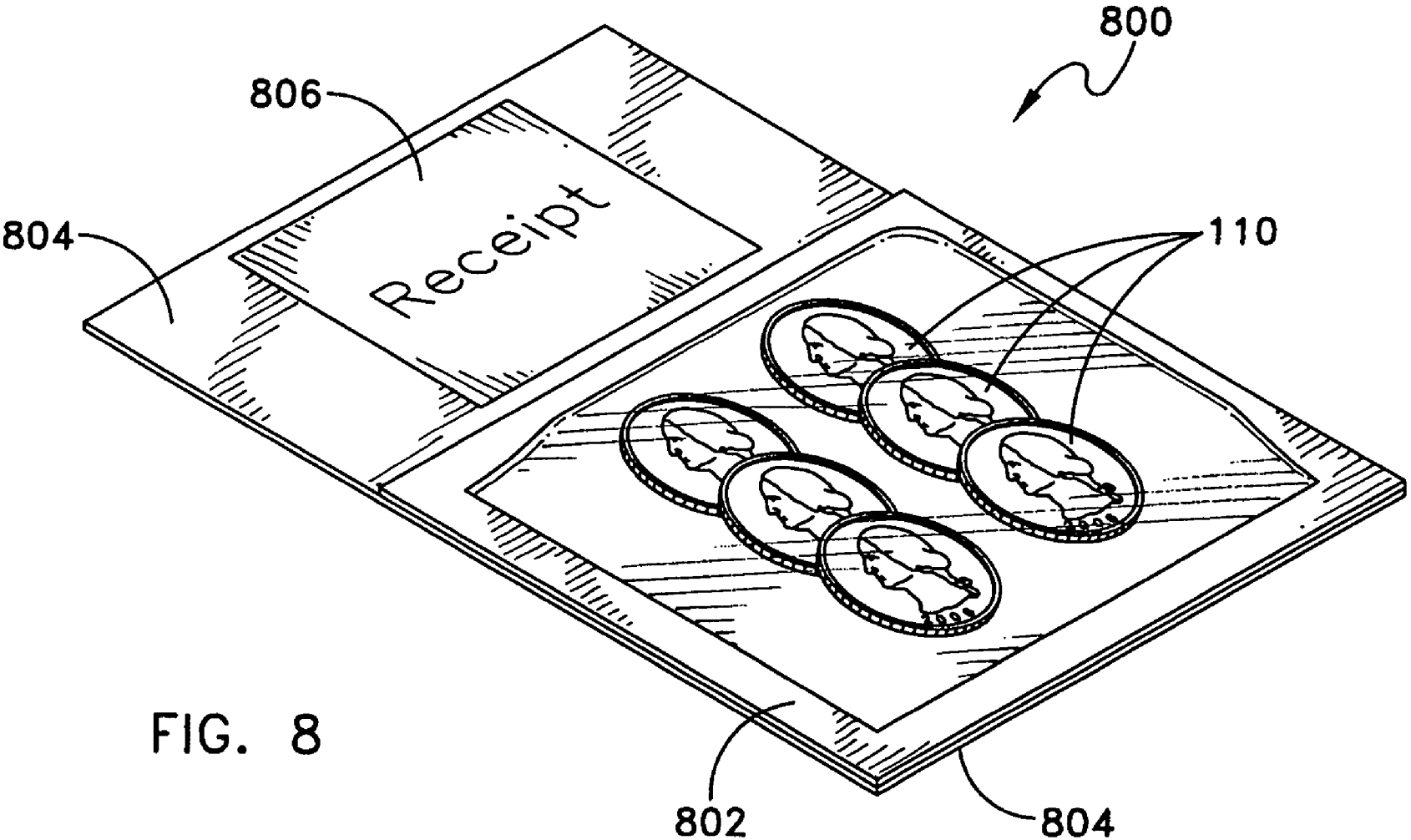
FIG. 8 illustrates a coin package with exemplary second printing area.

FIG. 8 illustrates coin package 800 with exemplary second printing area 806. Coins 110 are packaged in coin package 800 between top sheet 802 and bottom sheet 804. In one embodiment, printing area 806 is on the coin-side of bottom sheet 804. In another embodiment, top sheet 802 covers bottom sheet 804 and printing area 806 is either upon top sheet 802 or on the coin side of bottom sheet 804.

Figure 9:
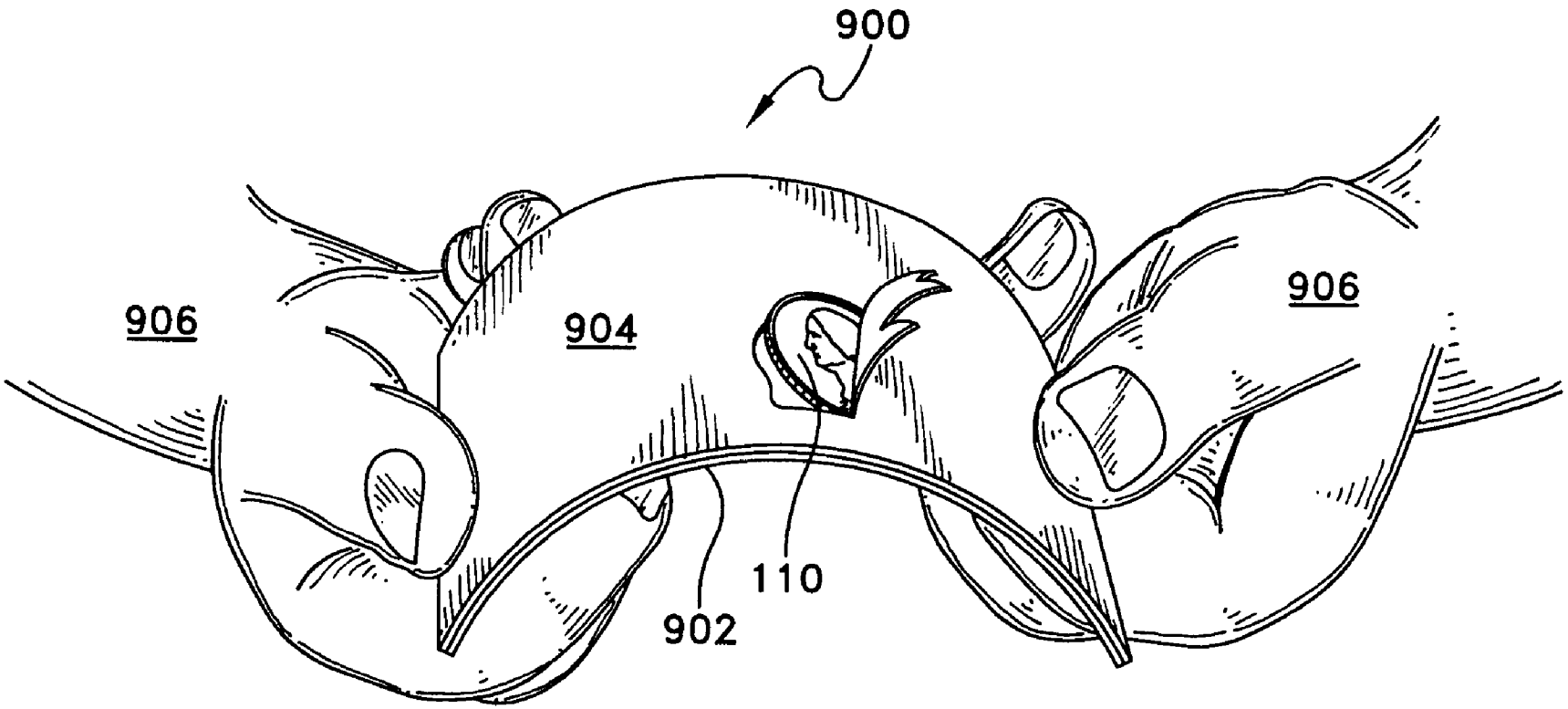
FIG. 9 illustrates a person retrieving coins from within a coin package.

FIG. 9 illustrates person 906 retrieving coins 110 from within coin package 900. In the embodiment illustrated, coin package 900 facilitates accessing coins 110 via bottom sheet 904. Bottom sheet 904 may be weakened (e.g., perforated, thinned, segmented, brittle) to assist in the accessing of coins 110. The selection of materials for top sheet 902 and bottom sheet 904 may facilitate accessing coins 110 by punching through top sheet 902. In another embodiment, coins 110 may be retrieved via separating top sheet 902 and bottom sheet 904.

Figure 10:
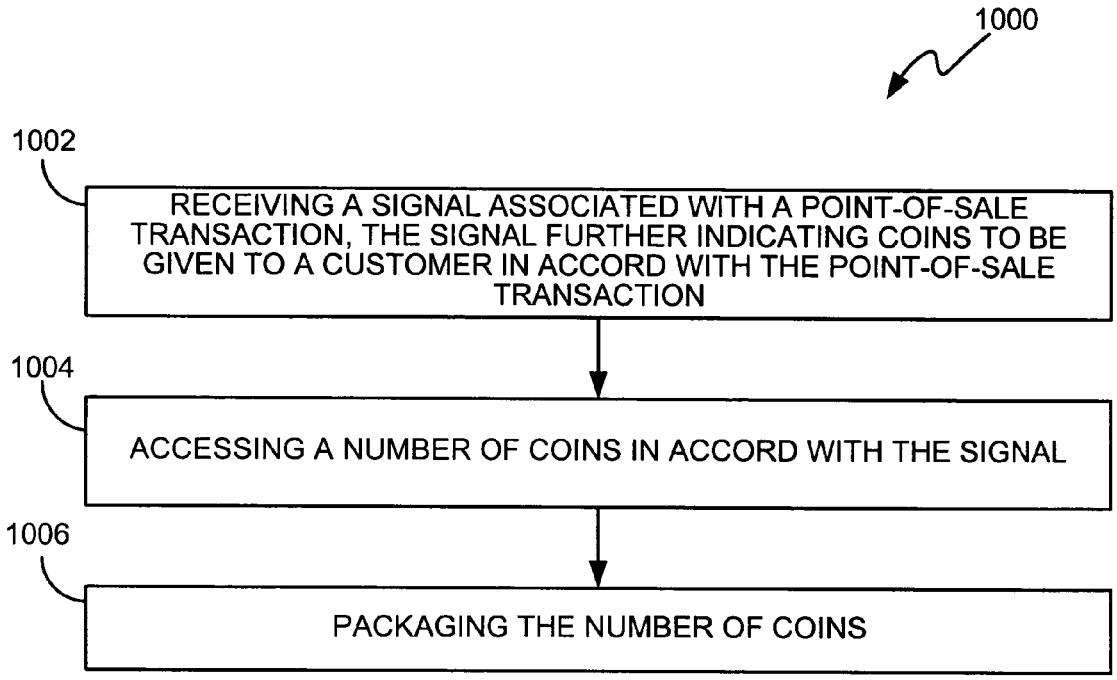
FIG. 10 illustrates an exemplary method for packaging coins.

FIG. 10 illustrates an exemplary method for packaging coins. Method 1000 includes steps 1002, 1004, 1006 for A) receiving a signal associated with a point-of-sale transaction, the signal further indicating coins to be given to a customer in accord with the point-of-sale transaction; B) accessing a number of coins in accord with the signal; and C) packaging the number of coins in a substantially planar package.

In one embodiment, step 1006 packages the number of coins with at least one coin overlapping and least one other coin. All coins may at least partially overlap one other coin, more than one coin, or various combinations of overlap, stacked, and/or individual coins provided the overall package does not create a single column.

In another embodiment, method 1000 includes additional steps for A) receiving the signal, wherein the signal further indicates the denomination of ones of the coins; and B) accessing the number of coins in accord with the denomination of ones of the coins.

In another embodiment, the packaging of the coins restricts the motion of the coins within the package.

In yet another embodiment, printing is placed on the package.

In still another embodiment, generating the signal in response to an input. For example, a user may press a number of buttons to generate the signal and package a number of coins in accord with the button presses.

What is claimed is:

1. A method of automatically packaging coins, comprising:
receiving a signal associated with a point-of-sale transaction, the signal further indicating coins to be given to a customer in accord with the point-of-sale transaction;
accessing a number of coins in accord with the signal; and
packaging the number of coins.

2. The method of claim 1, further comprising packaging the number of coins in a substantially planar package.

3. The method of claim 1, further comprising packaging the number of coins with at least one coin overlapping and least one other coin.

4. The method of claim 1, further comprising:
receiving the signal, wherein the signal further indicates the denomination of ones of the coins; and
accessing the number of coins in accord with the denomination of ones of the coins.

5. The method of claim 1, further comprising packaging the coins to restrict the motion of the coins within the package.

6. The method of claim 1, further comprising printing on a surface forming the package.

7. The method of claim 1, further comprising generating the signal in response to an input.

8. A system, comprising
an interface to receive a signal associated with a point-of-sale transaction, the signal further indicating coins to be given to a customer in accord with the point-of-sale transaction;
a first dispenser to access a number of coins in accord with the signal; and
a packager to package the accessed coins.

9. The system of claim 1, wherein the packager packages the accessed coins in a substantially planar form.

10. The system of claim 1, further comprising a second dispenser to dispense the packaged coins.

11. The system of claim 1, wherein the packager packages the accessed coins such that at least one coin overlaps at least one other coin.

12. The system of claim 1, wherein:
the signal further indicates the denomination of the coins; and
the first dispenser accesses the number of coins in accord with the denomination of the coins.

13. The system of claim 1, wherein the packager packages the coins to restrict the motion of the coins within the package.

14. The system of claim 1, further comprising a printer to print on a surface forming the package.

15. An apparatus, comprising,
signal processor to process a received signal indicating coins to be packaged in response to a point-of-sale transaction;
a magazine operable to hold coins;
a first dispenser to access a number of coins, from the magazine, in accord with the signal; and
a packager to package the accessed coins.

16. The apparatus of claim 15, wherein the packager packages the coins in a substantially planar form.

17. The apparatus of claim 15, wherein the packager packages the accessed coins such that at least one coin overlaps at least one other coin.

18. The apparatus of claim 15, wherein: the first dispenser accesses the number of coins in accord with a denomination indicator of the signal.

19. The apparatus of claim 15, wherein the packager packages the coins to restrict the motion of the coins within the package.

20. The apparatus of claim 15, further comprising a printer to print on a surface forming the package.

21. The apparatus of claim 15, further comprising signal generator, in communication with the processor, to generate the signal.

* * * * *